US007094992B1

(12) United States Patent
Wray et al.

(10) Patent No.: US 7,094,992 B1
(45) Date of Patent: Aug. 22, 2006

(54) APPARATUS FOR STORING AND WARMING A PLURALITY OF WIPES

(76) Inventors: Anton Wray, 678 Hungry Harbor Rd., North Woodmere, NY (US) 11581; Joan Wray, 678 Hungry Harbor Rd., North Woodmere, NY (US) 11581

( * ) Notice: Subject to any disclaimer, the term of this patent is extended or adjusted under 35 U.S.C. 154(b) by 0 days.

(21) Appl. No.: 11/188,355

(22) Filed: Jul. 25, 2005

(51) Int. Cl.
*B65D 25/52* (2006.01)
*B65D 81/17* (2006.01)
*B65D 83/08* (2006.01)
*A47K 10/24* (2006.01)

(52) U.S. Cl. ..... 219/386; 222/146.5

(58) Field of Classification Search ..... None
See application file for complete search history.

(56) References Cited

U.S. PATENT DOCUMENTS

| | | | | |
|---|---|---|---|---|
| D301,923 | S * | 6/1989 | Koschuta | D23/332 |
| 4,857,708 | A * | 8/1989 | DeMars | 219/385 |
| 4,943,705 | A | 7/1990 | Halloran | |
| 5,004,894 | A | 4/1991 | Whitehead | |
| 5,036,178 | A | 7/1991 | Orbach | |
| 5,210,396 | A | 5/1993 | Sanders | |
| 5,231,266 | A * | 7/1993 | Warren | 219/521 |
| D362,493 | S * | 9/1995 | Begum | D23/314 |
| D390,645 | S * | 2/1998 | Hanrahan et al. | D23/332 |
| 5,736,714 | A | 4/1998 | Bechtold, Jr. | |
| 5,738,082 | A * | 4/1998 | Page et al. | 126/263.01 |
| 5,842,287 | A | 12/1998 | Murphy | |
| 6,170,389 | B1 | 1/2001 | Brady | |
| 6,316,750 | B1 * | 11/2001 | Levin | 219/438 |
| 6,331,696 | B1 * | 12/2001 | Nakamura et al. | 219/386 |
| 6,526,873 | B1 | 3/2003 | Brady | |
| 6,610,966 | B1 * | 8/2003 | Julius | 219/386 |
| 6,639,185 | B1 * | 10/2003 | McConnell et al. | 219/386 |
| 6,774,343 | B1 * | 8/2004 | Ibanez | 219/386 |
| 6,776,305 | B1 * | 8/2004 | Motsenbocker | 221/63 |
| 2002/0030045 | A1 | 3/2002 | Nakamura et al. | |
| 2003/0015513 | A1 * | 1/2003 | Ellis | 219/400 |
| 2003/0155343 | A1 | 8/2003 | Ibanez | |

FOREIGN PATENT DOCUMENTS

JP 1108974 A * 4/1999

* cited by examiner

*Primary Examiner*—Joseph Pelham
(74) *Attorney, Agent, or Firm*—Thomas R. Lampe

(57) ABSTRACT

A portable apparatus for storing and warming a plurality of stacked flexible wipes includes a heater coil, electrical circuitry controlling operation of the heater coil and a cover closing the housing interior and having a cover opening selectively opened or closed by a closure to allow access to wipes even when the cover is in closed position. Projections in the housing interior support the wipes in elevated condition to promote even heat distribution.

6 Claims, 4 Drawing Sheets

APPARATUS FOR STORING AND WARMING A PLURALITY OF WIPES

TECHNICAL FIELD

This invention relates to a portable apparatus for storing and warming a plurality of stacked flexible wipes, for example moistened towelettes.

BACKGROUND OF THE INVENTION

Moistened wipes or towelettes are well known, as are arrangements for heating such articles. The devices disclosed in the following U.S. patents and patent publications are believed to be representative of the current state of the art in this field: U.S. Pat. No. 4,857,708, issued Aug. 15, 1989, U.S. Pat. No. 5,036,178, issued Jul. 30, 1991, U.S. Pat. No. 5,004,894, issued Apr. 2, 1991, U.S. Pat. No. 6,526,873, issued Mar. 4, 2003, U.S. Pat. No. 6,170,389, issued Jan. 9, 2001, U.S. Pat. No. 4,943,705, issued Jul. 24, 1990, U.S. Pat. No. 5,210,396, issued May 11, 1993, U.S. Pat. No. 5,736,714, issued Apr. 7, 1998, U.S. Pat. No. 5,842,287, issued Dec. 1, 1998, U.S. Design Pat. No. D390,645, issued Feb. 10, 1998, U.S. Patent Publication No. US 2003/0155343, published Aug. 21, 2003, and U.S. Patent Publication US 2002/0030045, published Mar. 14, 2002.

As will be seen below, the apparatus of the present invention incorporates structural features and cooperative relationships which are not taught or suggested by the known prior art, whether taken alone or in combination. Such features and their cooperative relationships contribute to the efficient operation of the subject apparatus.

DISCLOSURE OF INVENTION

The apparatus of the present invention is for storing and warming a plurality of stacked flexible wipes.

The apparatus includes a housing defining a heater coil compartment, a housing interior for containing wipes and a top opening. The housing interior is in communication with the top opening and not in communication with the heater coil compartment.

A heater coil is disposed in the heater coil compartment.

Electrical circuitry in the housing is operatively associated with the heater coil to control operation of the heater coil, the electrical circuitry being electrically isolated from the housing interior and from any wipes contained in the housing interior.

A switch is employed for selectively alternatively activating or deactivating the electrical circuitry.

A cover is operatively associated with the housing and selectively movable relative to the housing between a closed position wherein the cover is disposed over the housing interior and closes the top opening and an open position wherein the housing interior is accessible through the top opening to place wipes therein.

The cover defines a cover opening and includes a closure movable relative to the remainder of the cover for selectively opening or closing the cover opening. The cover opening is smaller than the top opening and allows manual access to wipes in the housing interior to dispense the wipes through the cover opening when not closed by the closure when the cover is disposed over the housing interior.

Other features, advantages and objects of the present invention will become apparent with reference to the following description and accompanying drawings.

BEST MODE FOR CARRYING OUT THE INVENTION

Figure 1:
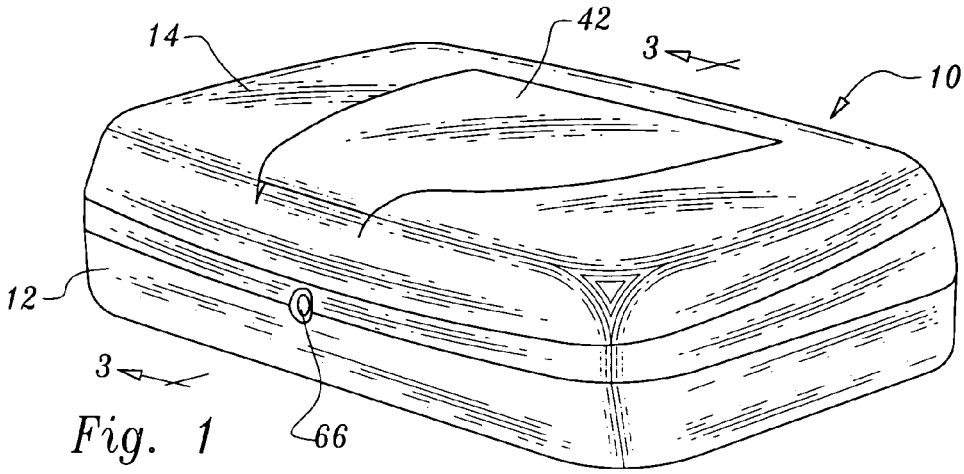
FIG. 1 is a frontal, perspective view illustrating a preferred form of portable apparatus constructed in accordance with the teachings of the present invention, the cover of the apparatus being closed.

Apparatus constructed in accordance with the teachings of the present invention is designated in the drawings by reference numeral 10. The apparatus is for storing and warming a plurality of stacked flexible wipes, the apparatus being particularly useful for use in connection with moistened towelettes. The apparatus stores the towelettes and warms them prior to dispensing by a user. As will be seen below, structure incorporated in the apparatus serves to maintain the towelettes in moistened, warm condition prior to dispensing and use thereof.

The apparatus 10 is of a portable nature and may be operated by battery or by direct interconnection with an external AC power source.

The apparatus includes a housing 12 and a cover 14 formed of any suitable material such as plastic material. The housing and cover are constructed in any desired manner to provide them with insulating properties, such feature contributing to the efficiency of the apparatus and also providing longer life for a battery or batteries disposed therein to operate electrical circuitry of the apparatus. The housing and cover are pivotally connected at the rear of the apparatus by pivot connection 16.

Housing 12 defines a heater coil compartment 18, a housing interior 20 for containing wipes and a top opening 22. The housing interior is in communication with the top opening and not in communication with the heater coil compartment, the latter being disposed under the housing interior.

Cover 14 is selectively movable relative to the housing about pivot connection 16 between a closed position (shown in FIGS. 1–3) wherein the cover is disposed over the housing interior 20 and sealingly closes the top opening and an open position (shown in FIG. 4) wherein the housing interior is accessible through the top opening to place wipes therein.

Figure 3:
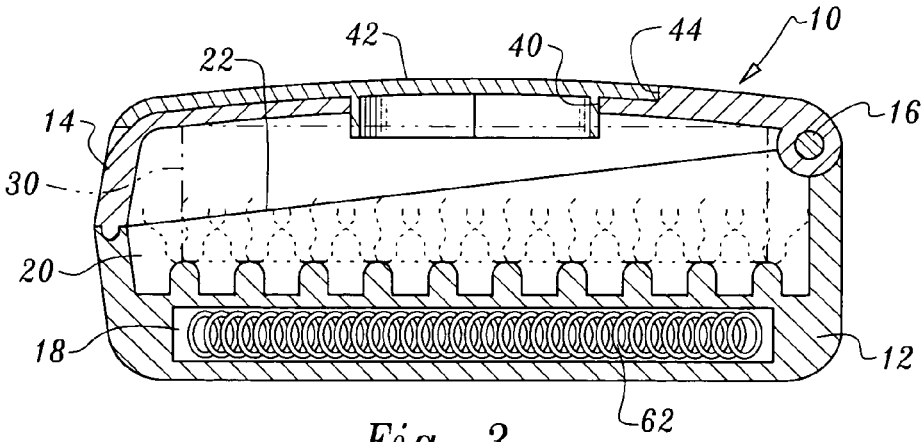
FIG. 3 is a cross-sectional view taken along the line 3—3 of FIG. 1.
Figure 4:
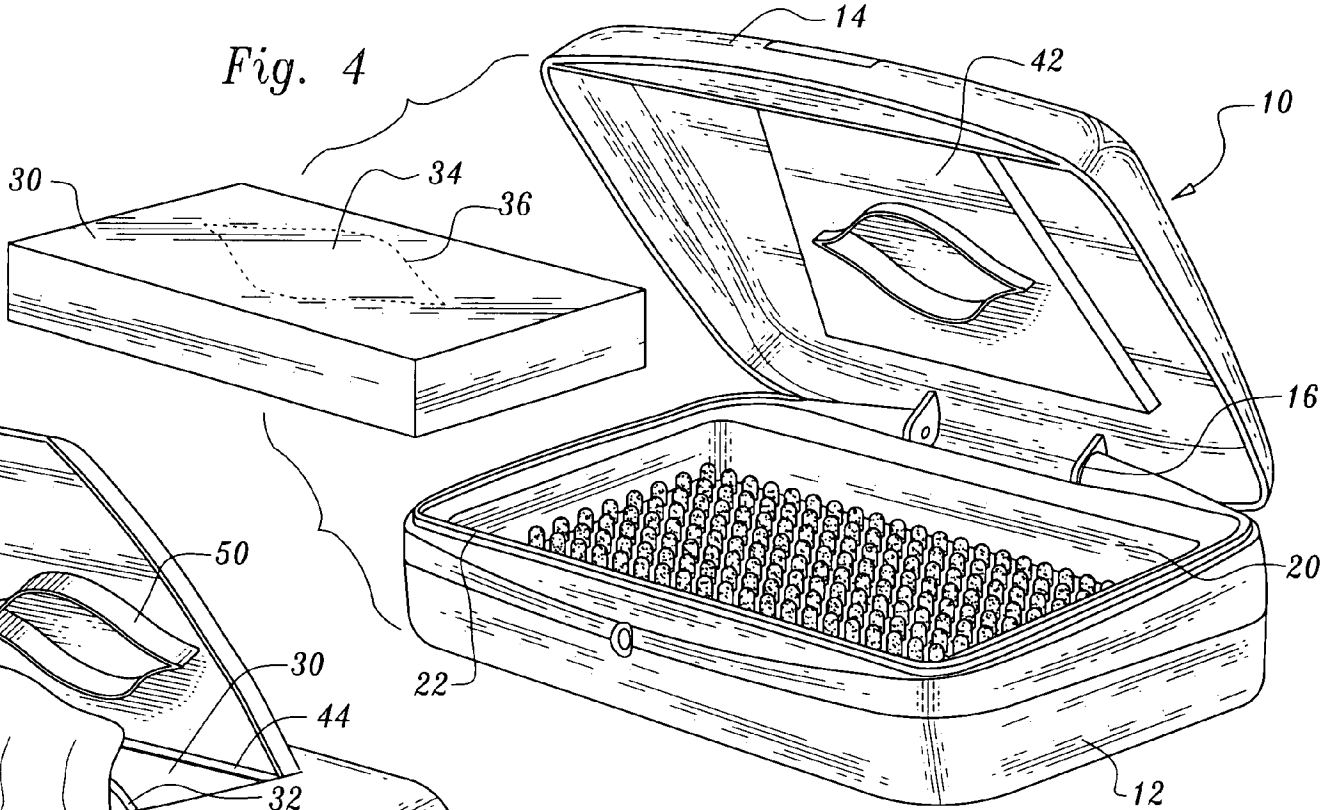
FIG. 4 is an exploded, perspective view illustrating the cover of the apparatus open to expose the interior of the apparatus housing and prior to insertion of a package of stacked wipes into the housing interior.
Figure 5:
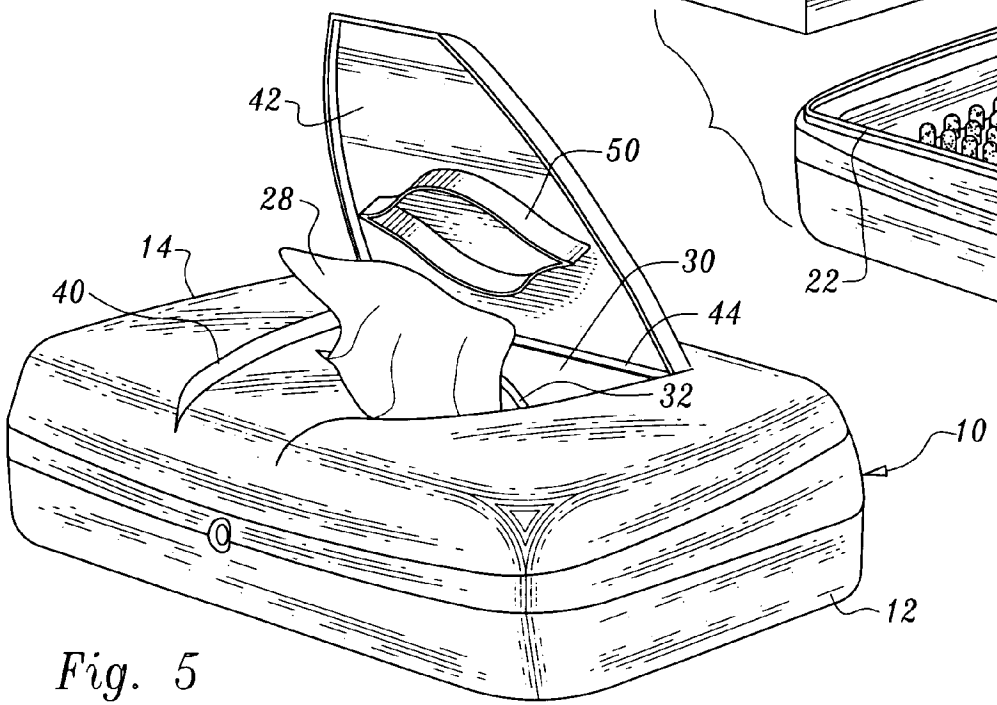
FIG. 5 is a perspective view illustrating the cover closed and a closure of the cover open to allow access to wipes within the housing interior for dispensing purposes.

In the arrangement illustrated, a stack of wipes in the form of moistened towelettes 28 is disposed in a package or insert 30, the package 30 having a dispensing opening 32 formed therein. The dispensing opening is covered until use by a portion 34 connected to the rest of the package by perforated tear lines 36, the portion 34 serving to maintain the towelettes in the package in moistened condition. FIGS. 3 and 5 show the package 30 in place within the housing interior. It should be pointed out that, if desired, wipes may be stacked in the housing interior after having been removed from their original package.

The cover 14 defines a cover opening 40 and includes a flap-type closure 42. Closure 42 is movable relative to the remainder of the cover about a pivot connection 44, such as a live hinge, for selectively opening or closing the cover opening. The cover opening is smaller than the top opening and allows manual access to wipes in the housing interior (see FIG. 5) to dispense the wipes through the cover opening when not closed by the closure when the cover is disposed over the housing interior.

It is to be noted that the dispensing opening 32 of the package or insert 30 is disposed under and in communication with the cover opening 40 when the package and wipes are disposed within the housing interior.

Closure 42 includes a projecting seal element 50 which engages the package about the dispensing opening 32 when the closure closes the cover opening 40. This reduces drying of the wipes, i.e. prevents moisture loss therefrom, when the apparatus is employed with moistened towelettes or other moistened wipes.

The housing 12 includes a housing bottom wall 54 at the bottom of the housing interior. Spaced projections 56 extend upwardly from the bottom wall and support the wipes in the housing interior above and spaced from the bottom wall. These spaced projections define passageways allowing circulation of heated air within the housing interior about the wipes supported by the projections to provide even heat distribution to the wipes.

An electrical circuitry module 60 is incorporated in housing 12, the electrical circuitry thereof being operatively associated with heater coil 62 disposed in heater coil compartment 18. The electrical circuitry and heater coil are electrically isolated from the housing interior and from wipes contained in the housing interior.

Figure 2:
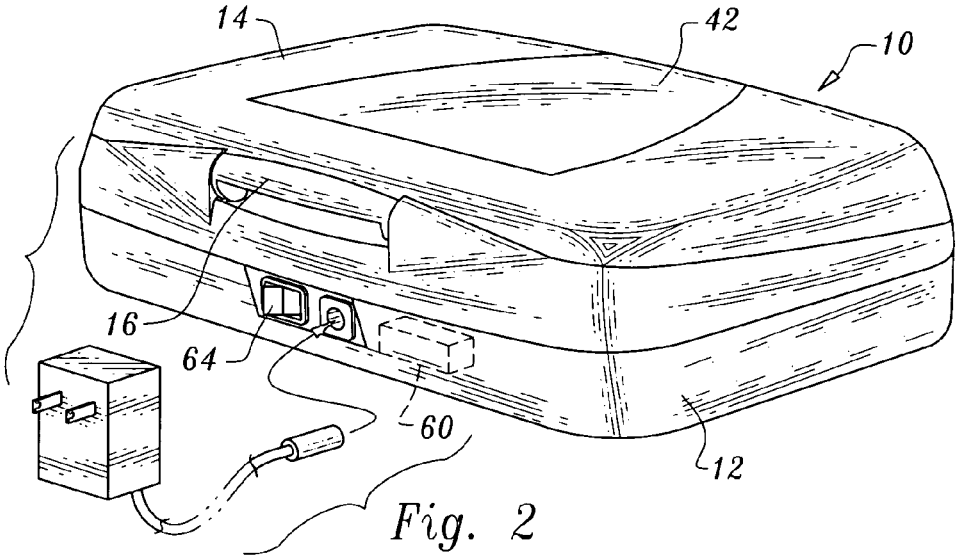
FIG. 2 is a rear, perspective view of the closed apparatus, including an AC/DC transformer prior to interconnection with the apparatus housing.
Figure 6:
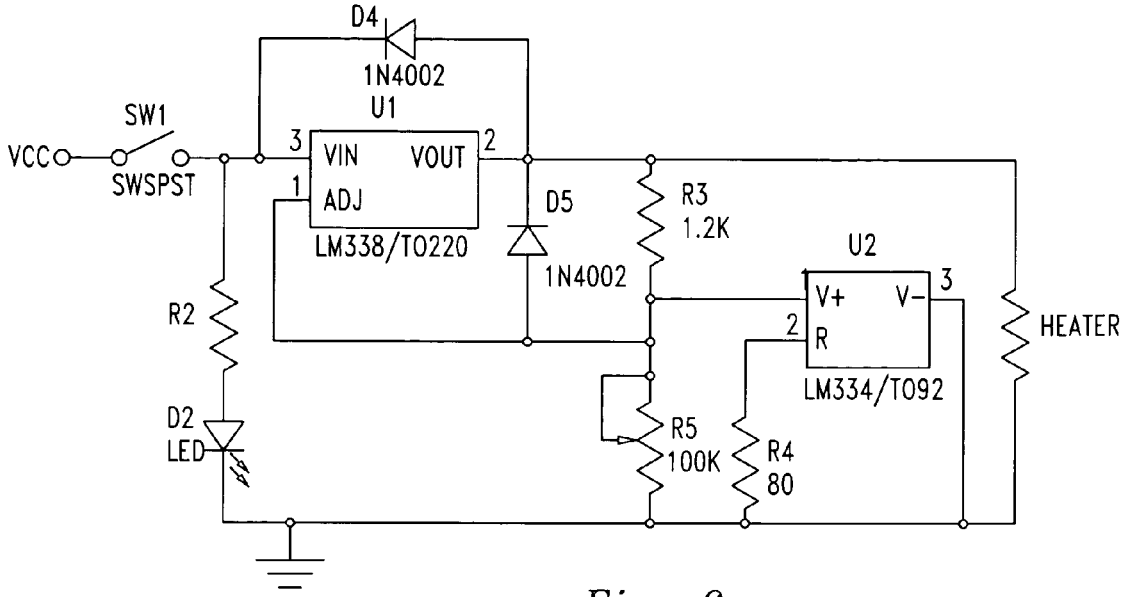
FIG. 6 is a circuit diagram of a wipe warmer heater temperature control incorporated in electrical circuitry of the apparatus.
Figure 7:
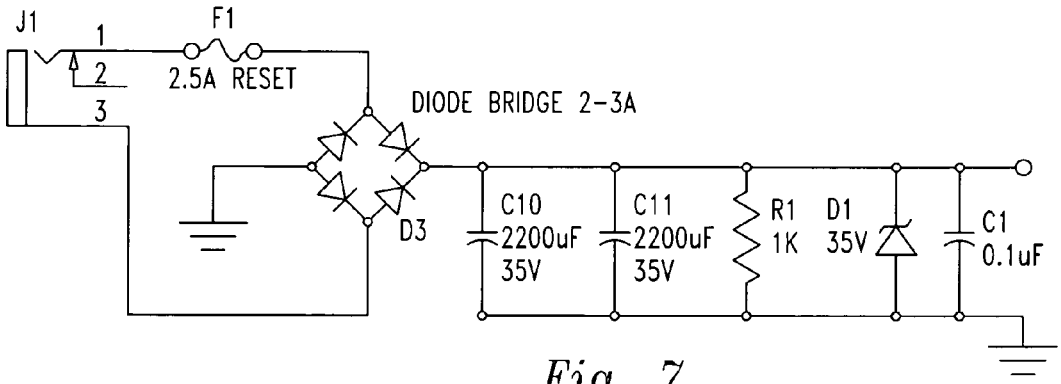
FIG. 7 is a circuit diagram of a wipe warmer power supply incorporated in the electrical circuitry of the apparatus.
Figure 8:
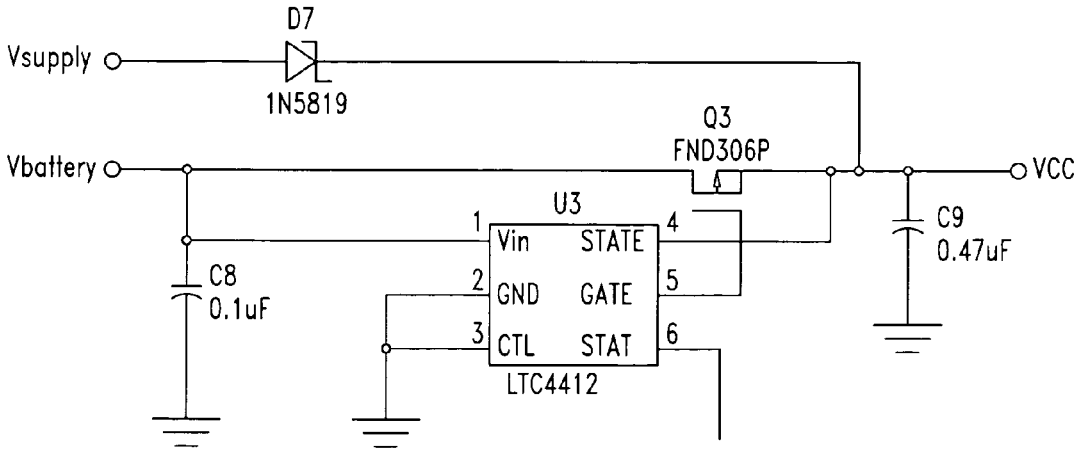
FIG. 8 is a circuit diagram of a wipe warmer power switch-over controller incorporated in the electrical circuitry of the apparatus.
Figure 9:
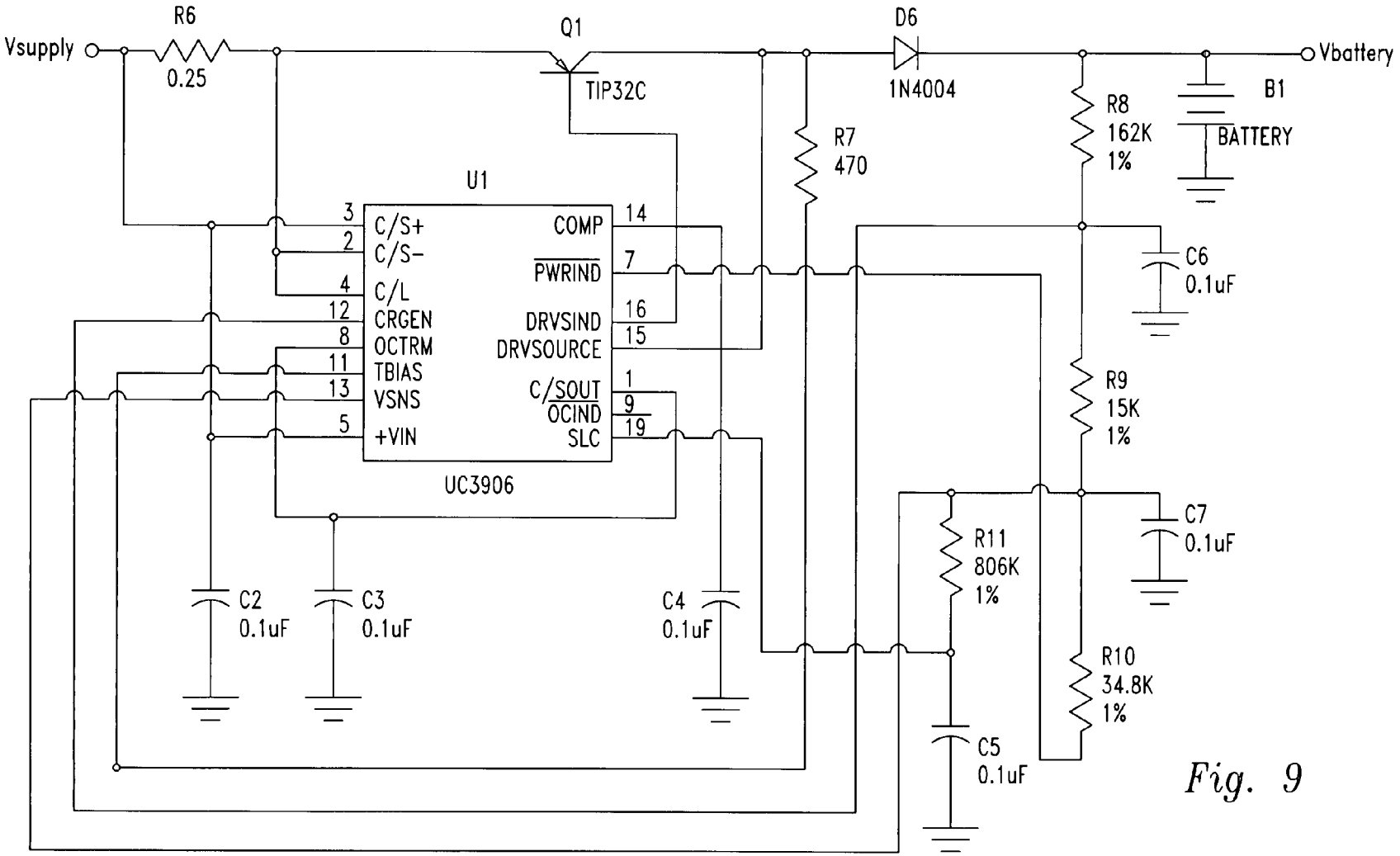
FIG. 9 is a circuit diagram of a wipe warmer battery charger incorporated in the electrical circuitry of the apparatus.

FIGS. 6–9 disclose suitable sub-circuits which may be employed in the electrical circuitry of the invention. FIG. 6 is a circuit diagram of a wipe warmer heater temperature control incorporated in the circuitry. FIG. 7 is a circuit diagram of a wipe warmer power supply which may be employed. FIG. 8 is a circuit diagram of a wipe warmer switch-over controller incorporated in the electrical circuitry of the apparatus, and FIG. 9 is a circuit diagram of a wipe warmer battery charger of a suitable type. It will be appreciated that electrical circuitry of the disclosed type may be utilized to convert the apparatus for either battery powered or AC powered use, a switch 64 on the housing being utilized to selectively alternatively activate or deactivate the electrical circuitry. FIG. 2 shows an AC/DC transformer prior to interconnection between the apparatus and a standard wall socket. An indicator light 66 on the housing is employed to indicate activation of the electrical circuitry.

The invention claimed is:

1. Apparatus for storing and warming a plurality of stacked flexible wipes, said apparatus comprising, in combination:

a housing defining a heater coil compartment, a housing interior for containing wipes and a top opening, said housing interior in communication with said top opening and not in communication with said heater coil compartment;

a heater coil disposed in said heater coil compartment;

electrical circuitry in said housing operatively associated with said heater coil to control operation of said heater coil, said electrical circuitry being electrically isolated from said housing interior and from any wipes contained in the housing interior;

a switch for selectively alternatively activating or deactivating said electrical circuitry; and a cover operatively associated with said housing and selectively movable relative to said housing between a closed position wherein said cover is disposed over said housing interior and closes said top opening and an open position wherein said housing interior is accessible through said top opening to place wipes therein, said cover defining a cover opening and including a closure movable relative to the remainder of said cover for selectively opening or closing said cover opening, said cover opening being smaller than said top opening and allowing manual access to wipes in said housing interior to dispense said wipes through said cover opening when not closed by said closure when said covering is disposed over said housing interior, said housing including a housing bottom wall at the bottom of said housing interior and projections extending upwardly from said bottom wall for supporting wipes in said housing interior above and spaced from said bottom wall.

2. The apparatus according to claim 1 wherein said projections are spaced from one another and define passageways allowing circulation of heated air within said housing interior about the wipes supported by said projections.

3. The apparatus according to claim 1 including a pivot connection between said housing and said cover.

4. The apparatus according to claim 1 including a pivot connection between said closure and the remainder of said cover.

5. The apparatus according to claim 1 additionally comprising a package containing said wipes, said package having a dispensing opening disposed under and in communication with said cover opening when said package and wipes are disposed within said housing interior.

6. Apparatus for storing and warming a plurality of stacked flexible wipes, said apparatus comprising, in combination:

a housing defining a heater coil compartment, a housing interior for containing wipes and a top opening, said housing interior in communication with said top opening and not in communication with said heater coil compartment;

a heater coil disposed in said heater coil compartment;

electrical circuitry in said housing operatively associated with said heater coil to control operation of said heater coil, said electrical circuitry being electrically isolated from said housing interior and from any wipes contained in the housing interior;

a switch for selectively alternatively activating or deactivating said electrical circuitry; and a cover operatively associated with said housing and selectively movable relative to said housing between a closed position wherein said cover is disposed over said housing interior and closes said top opening and an open position wherein said housing interior is accessible through said top opening to place wipes therein, said cover defining a cover opening and including a closure movable relative to the remainder of said cover for selectively opening or closing said cover opening, said cover opening being smaller than said top opening and allowing manual access to wipes in said housing interior to dispense said wipes through said cover opening when not closed by said closure when said cover is disposed over said housing interior, and said closure including a projecting seal element engageable with said package about said dispensing opening when said closure closes said cover opening to substantially prevent moisture loss from wipes in said package.

* * * * *